United States Patent [19]

Gilomen

[11] 4,112,673

[45] Sep. 12, 1978

[54] OPERATING MECHANISM FOR MECHANICAL WATCH MOVEMENT

[75] Inventor: Beat Gilomen, Lengnau, Switzerland

[73] Assignee: A. Schild S.A., Grenchen, Switzerland

[21] Appl. No.: 776,617

[22] Filed: Mar. 11, 1977

[30] Foreign Application Priority Data

Mar. 18, 1976 [CH] Switzerland ..... 3422/76

[51] Int. Cl.[2] ..... G04B 19/24; G04B 27/02

[52] U.S. Cl. ..... 58/85.5; 58/58; 58/59; 58/63; 58/73

[58] Field of Search ..... 58/4 R, 57–59, 58/63, 73, 80, 85.5

[56] References Cited

U.S. PATENT DOCUMENTS 3,664,119 5/1972 Besson ..... 58/58

FOREIGN PATENT DOCUMENTS 222,583 10/1942 Switzerland ..... 58/85.5

*Primary Examiner*—Stanley J. Witkowski

*Attorney, Agent, or Firm*—Stevens, Davis, Miller & Mosher

[57] ABSTRACT

A watch movement is disclosed which is capable of being equipped either with or without a calendar mechanism without the need for structural modification of the movement. The setting lever spring of the unit is formed by a linear arm of the guard plate and provided with a head having a front and rear edge each with two opposite ramps arranged to cooperate with a pin to fix the spring in a different position depending on whether or not the movement is to be equipped with a calendar mechanism.

8 Claims, 3 Drawing Figures

OPERATING MECHANISM FOR MECHANICAL WATCH MOVEMENT

The present invention relates to an operating mechanism for a mechanical watch movement comprising an operating stem arranged radially with respect to the movement, a clutch pinion engaged on said stem, a setting lever, and a yoke, these two parts pivoting around parallel axes and being arranged so as to displace the clutch pinion in response to a displacement of the stem, and a guard plate cut with a linear elastic arm which serves as setting-lever spring and has a spring head at its free end, said head having a front edge and a rear edge and the setting lever being equipped with a pin which cooperates with one of the edges of the head so as to hold the mechanism in several different positions.

Winding and hand-setting mechanisms of the present type have been known for a long time and are used frequently in watch movement, and particularly wristwatch movements. In the case of ordinary movements without calendar mechanisms, the head of the setting-lever spring has on its profiled edge two notches which fix the position of the setting lever, and therefore the winding stem, in the inner winding position and in the outer hand-setting position. On the other hand, in the case of watch movements with calendar mechanisms, the profiled edge of the spring head frequently has three notches, the two extreme notches being intended to fix the position of the setting lever and the stem in the two customary positions of winding and hand-setting, while the central notch fixes the mechanism in an intermediate position, in which it can control a calendar correction mechanism. The setting-lever springs used in these two types of calibers are therefore of different shape.

It is moreover known that the present trend in the manufacture of watch movements is toward uniformity in sizes in order to use the same parts as much as possible for watch movements whose final appearance is varied by the simple addition of elements adapted for the desired appearance. Thus, for instance, one strives to produce certain sizes whether in movements without calendar mechanisms or in movements with calender mechanisms, by producing a standard unit and adding to it specific auxiliary equipment depending on the appearance desired.

It is obviously advantageous for this auxiliary equipment to be as small as possible.

The present invention proposes improving the production of various sizes of mechanisms which permit the introduction of the setting-lever spring, of the setting lever, and of the yoke of the customary winding and hand-setting mechanisms in a basic unit capable of being equipped either with a movement with or without a calendar mechanism. The result is that these parts, that is to say the setting-lever spring, the setting lever, the yoke as well as the hand-setting wheel can be manufactured in series, the quantities of which correspond to the total quantity of all sizes of mechanisms manufactured. The result also is that the operation of fastening the setting lever spring to the pillar plate can be effected without it being necessary to take into account the particular size of the finished unit.

For this purpose, the operating mechanism in accordance with the present invention, is characterized by the fact that the front edge and the rear edge of the head of the setting-lever spring both have at their ends two opposite ramps arranged in such a manner as to be able to cooperate with the pin in order to fix the mechanism in two extreme positions.

One embodiment of the mechanism in accordance with the present invention will be described below, by way of example, with reference to the accompanying drawing, in which.

Figure 1:
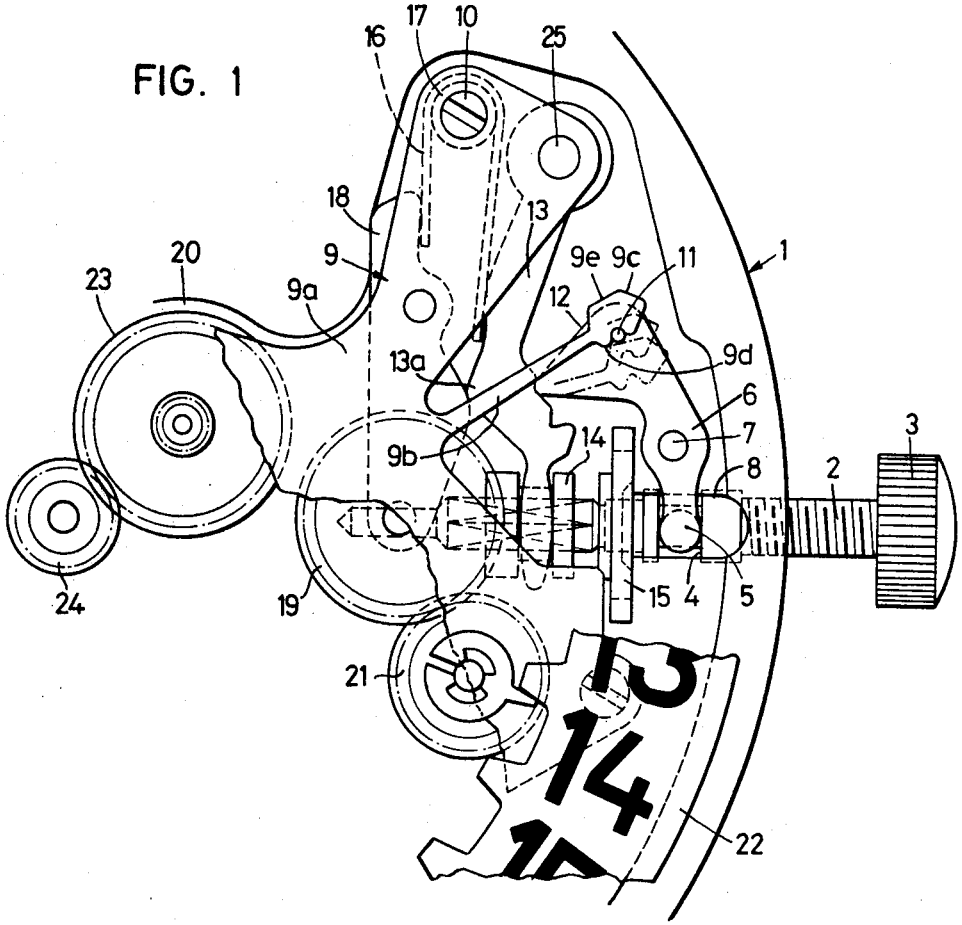
FIG. 1 is a top plan view of the mechanism.

FIG. 1 shows the circular or pillar plate 1 of a wristwatch movement. The mechanism of this movement comprises a winding stem 2, the outer end of which bears a crown 3 and which, like ordinary stems, has a groove of rectangular profile 4, into which there is engaged the pin 5 of a setting lever 6. The setting lever 6 is pivoted on a setting-lever axle 7. The setting lever is mounted on the pillar plate 1 and its pin 5 passes through an elongated opening 8 arranged through the piller plate and which opens into a recess provided in its outer face. Thus, the pin 5 reaches the groove 4 and is engaged in said groove.

The winding and hand-setting mechanism of the watch described comprises elements which make it possible to equip the the movement either in the form of a watch without a calendar mechanism or in the form of a watch with a calendar mechanism but without corrector, or finally in the form of a watch with a calendar mechanism and corrector.

The setting lever 6 has a nose 12 which cooperates with a yoke 13 pivoting around a stud 25 rigidly connected with the pillar plate 1.

The yoke 13, like all normal yokes, has an extension **13*a* which engages in an annular groove present in the clutch pinion 14. The latter is mounted on a square of the stem 2 and its front Breguet toothing cooperates with a similar toothing present on the winding pinion 15. The latter is supported by a cylindrical surface of the stem 2 and it is mounted idly on this stem. Its position in axial direction is delimited by the edges of a shoulder which forms an extension of the cutout 8**.

The yoke 13 is urged by a spring wire 16 which is engaged around a sleeve 17 which is traversed by the screw 10 for the fastening of the guard plate 9. One of the ends of this spring 16 acts on a lever 18 which has a hand-setting wheel 19 at the end thereof opposite the end on which the end of the spring 16 rests. Said setting wheel pivots around a stud which is firmly connected with the lever 18 and it is held in place by the guard plate 9 and by the flat surface of the lever 18. In the position shown in the drawing, which is a calendar correction position as will be seen later on, the lever 18 at the end thereof cooperating with the spring 16 rests against the side of cutout 20 provided in the pillar plate so that it is held in abutting position. The setting wheel 19 is in engagement with the crown toothing of the pinion 14 and drives a corrector runner 21 which is capable of displacing a date ring 22.

Under the action of a pull exerted on the stem 2, the nose 12 of the setting lever 6 causes the yoke 13 and the lever 18 to pivot in clockwise direction as seen in FIG. 1. As a matter of fact, the nose **13*a* of the yoke 13 acts on the edge of the lever 18 so that, while remaining in engagement with the clutch pinion 14, the hand-setting wheel meshes in the minute wheel 23 which, in its turn, is in engagement with the cannon pinion 24** arranged at the center of the movement.

If, starting from the position shown in FIG. 1, the stem 2 is pushed inwards, the mechanism passes into the winding position. The lever 18 remains in the position which it occupies in FIG. 1, but the setting lever and yoke move, the former in clockwise direction and the latter in counter-clockwise direction, and, under the action of the right-hand arm of the spring wire 16, the yoke 13 moves the clutch pinion until the latter is in engagement with the winding pinion 15.

The different positions described above are assured by the setting-lever spring, which is formed by a linear arm **9*b* cut out from the surface 9*a* of the guard plate 9 and provided at its free end with a head 9*c* of generally hexagonal shape. The head 9*c* is limited by two profiled edges, namely a first front edge 9*d* which is of approximately W shape and a second, rear edge 9*e* which has the shape of a U with inclined legs. These two edges have at their ends oblique ramps which can cooperate with the pin 11 in order to fix the extreme positions of the mechanism. As stated previously these two edges determine the contour of the head 9*c* and its approximately hexagonal shape, with two sides parallel to each other and parallel to the axis of the arm 9*b*, one of these sides, the front side, being provided with a notch which constitutes the central portion of the W. It can be seen in FIG. 1, in dashed lines, the arm 9*b* and the head 9*c* as they appear when the spring is not cocked. The head 9*c* then extends above the pin 11 planted in the setting lever 6. In FIG. 1, the setting lever 6 is shown in a position which corresponds to an intermediate position of the winding stem 2, between the hand-setting position and the winding position. In this intermediate position, the clutch pinion 14 is disengaged from the winding pinion 15, but is not coupled to the minute wheel 23. The two positions shown in solid and dot-dash lines show that the head 9*c* of the setting-lever spring 9 can cooperate in two different manners with the pin 11, by means of a certain precocking. The precocking can be carried out by displacement of the head 9*c* in the direction of the stem 2, in which case the stem 11 is in contact with the edge 9*e* or rear edge of the head 9*c*, or by displacement in the other direction, in which case it is the edge 9*d* or front edge which cooperates with the pin 11. In the former case, the position shown in the drawing is a position capable of movement in which pulling or pushing movements on the stem do not occur so that this mounting is suitable for a movement whose winding and hand-setting mechanism requires only two operational positions of the stem. On the other hand, in the other case, the intermediate position will be a fixed position due to the engagement of the central notch of the edge 9*d* on the pin 11**. This mounting is suitable for calendar watches with correction mechanisms.

The different parts of the mechanism described can therefore be mounted either without calendar mechanism or with a calendar mechanism without corrector, or with calendar and corrector as shown in FIG. 1.

It is sufficient to give the elastic arm **9*b*** the precocking which is required.

Figure 2:
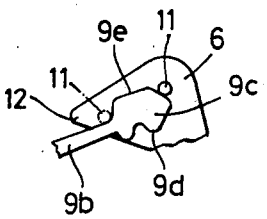
FIG. 2 is a partial plan view, illustrating the mounting of the mechanism in the case of equipment without a calendar mechanism.

FIG. 2 shows the relative positions of the setting lever 6 and of the head **9*c* when the rod is in winding position, in the case of mounting with two positions of the mechanism. The head 9*c* rests, via the outer oblique ramp of its edge 9*e*, against the pin 11, so that the setting lever is urged to rotate in clockwise direction. In this position, the stem is held by the engagement of pin 5 in the groove 4, while the pinion 15 is pressed by the clutch pinion 14 against a T-shaped shoulder of notch 8. The position of the stem and of the setting lever are thus defined both by the opening 8 and by the head 9*c*. FIG. 2 shows in broken lines the position of the pin 11 when the stem 2 is in the hand-setting position. Here the position of the stem is determined by the resting of the pin 5 against the edge of the opening 8** at the outer end of a circular member whose center is located on the axis of the stem.

Figure 3:
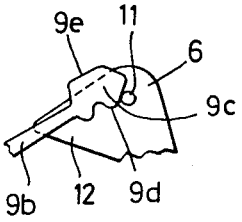
FIG. 3 is a view similar to FIG. 2 showing the mounting of the mechanism in the case of equipment with a calendar mechanism.

FIG. 3 shows the relative positions of the head **9*c*, the pin 11, and the setting lever 6 in the case of a mounting for a calendar movement. The stem is in winding position. The position of the setting lever is precisely the same as in FIG. 2 but the head 9*c* rests against the pin 11 via the outer ramp of its edge 9*d*. Although the direction of the force exerted by the head 9*c* on the pin 1, due to the precocking of the arm 9*b*, is not the same in the two cases, this force produces in both cases a moment of rotation which has a tendency to turn the setting lever in clockwise direction so that the final position of the stem is determined, as indicated previously, by the shape of the opening 8**.

In other embodiments, each of the edges **9*d* and 9*e* of the head 9*c*** have a number of positioning ramps or notches different from what is shown in the drawing. Furthermore, the arrangement described can be applied with any arrangement of setting lever and setting and winding mechanism.

The setting lever 6 can also have an actuating element other than the nose 12, for example, a bent portion or a pin.

Other modifications and embodiments which fall within the scope of the invention as described herein will be apparent to those skilled in the art.

What is claimed is:

1. An operating mechanism for a mechanical watch movement comprising a control stem arranged radially with respect to said movement, a clutch pinion engaged on said stem, a setting lever controlled through said stem, a yoke controlled through said setting lever and controlling said clutch pinion, said lever and yoke pivoting simultaneously in opposite directions around parallel axes in response to a displacement of the stem, a pivoting lever controlled through said yoke and having a hand setting wheel pivotally mounted thereon, means for maintaining said pivoting lever in an abutting position when it is not controlled through said yoke, and a guard plate provided with a linear elastic arm which acts as setting-lever spring and has a spring head at its free end, said head having a front edge and a rear edge and the setting lever being equipped with a pin which cooperates with one of the edges of the head so as to fix the mechanism in several different positions, the front edge and the rear edge of the head of the setting-lever spring both having at their ends two opposite ramps arranged so as to be able to cooperate with the pin in order to fix the mechanism in two extreme positions.

2. The mechanism according to claim 1, in which one of the edges of the head of the setting lever spring is provided, between the tops of its two ramps, with notch means for determining an intermediate position of the mechanism, and the tops of the two ramps of each edge determine a straight line which is perpendicular to the straight line joining the center of the pin to the axis of pivot of the setting lever when the latter is in said intermediate position.

3. A mechanism according to claim 2, in which one or more of the said extreme positions of the mechanism is determined by resting of a pin rigidly connected with the setting lever against the side of an opening provided in a housing element of the movement.

4. A mechanism according to claim 2, in which the two straight lines determined by the tops of the ramps of each edge of the head of the setting lever spring extend in divergent directions.

5. A mechanism according to claim 2, in which the said elastic arm extends in a direction parallel to said straight lines which are determined by the tops of the ramps.

6. A mechanism according to claim 1, in which the front edge of the head of the setting-lever spring has a notch in between the tops of its two ramps while the rear edge is cut in a straight line between the tops of its two ramps.

7. A mechanism according to claim 1, which further comprises a hairpin spring acting on the said yoke and on the pivoting lever which maintains the latter in a position in which it strikes against a housing element when the stem is in its extreme inner position, the clutch pinion being then in engagement with a winding pinion coaxial to the stem.

8. A mechanism according to claim 7, further comprising a minute wheel and the arrangement is such that in the outer extreme position of the stem, the said pivoting lever holds the hand-setting wheel in engagement with the minute wheel and with the clutch pinion, said pivoting lever being urged by the yoke, which in its turn is urged by a nose on the setting lever.

* * * * *